US005732483A

United States Patent [19]

Cagliari

[11] Patent Number: 5,732,483

[45] Date of Patent: Mar. 31, 1998

[54] SHOE FOR THE PRACTICE OF SNOWBOARDING

[75] Inventor: Césare Cagliari, Bigolino, Italy

[73] Assignee: Skis Rossignol S.A., Voiron, France

[21] Appl. No.: 680,321

[22] Filed: Jul. 12, 1996

[30] Foreign Application Priority Data

Jul. 17, 1995 [FR] France ..... 95 08836

[51] Int. Cl.[6] ..... A43B 5/04

[52] U.S. Cl. ..... 36/115; 36/117.1; 36/50.5; 36/58.5

[58] Field of Search ..... 36/115, 117.1, 36/7.5, 7.6, 50.5, 51, 58.5, 89, 91, 92, 114

[56] References Cited

U.S. PATENT DOCUMENTS

| | | | |
|---|---|---|---|
| 318,481 | 5/1885 | Kessel | 36/58.5 X |
| 460,743 | 10/1891 | Dickson, Jr. | 36/50.1 X |
| 1,160,162 | 11/1915 | Haas | 36/7.5 X |
| 1,712,481 | 5/1929 | Ayers | 36/170 |
| 3,234,667 | 2/1966 | Bovay | 36/58.5 X |
| 3,538,627 | 11/1970 | Labat-Camy | 36/7.5 X |
| 3,691,658 | 9/1972 | Di Perno et al. | 36/4 |
| 3,694,940 | 10/1972 | Stohr | 36/10 |
| 3,786,579 | 1/1974 | Clark et al. | 36/7.6 |
| 4,107,857 | 8/1978 | Devlin | 36/54 X |
| 4,281,468 | 8/1981 | Giese et al. | 36/50.5 X |
| 4,353,172 | 10/1982 | Bryant | 36/7.6 |
| 4,571,782 | 2/1986 | Ahn | 36/50.5 X |
| 4,635,383 | 1/1987 | Free | 36/7.6 |
| 4,856,210 | 8/1989 | Delery | 36/50.5 X |
| 5,184,378 | 2/1993 | Batra | 36/50.1 X |
| 5,497,564 | 3/1996 | Allen et al. | 36/50.1 |

FOREIGN PATENT DOCUMENTS

| | | | |
|---|---|---|---|
| 1041295 | 10/1978 | Canada | 36/4 |
| 617043 | 1/1949 | United Kingdom . | |

*Primary Examiner*—Ted Kavanaugh

*Attorney, Agent, or Firm*—Harris Beach & Wilcox, LLP

[57] ABSTRACT

A shoe for use in snowboarding includes an upper section having a bottom and opposed sides which enclose a wearer's foot and lower leg, and a sole that is secured to the bottom of the upper section. The upper section is made from a thermoformed plastic material which is more flexible than the material forming the sole. The sole includes a plurality of pairs of lateral extensions extending upwardly along each of the opposed sides for engaging with corresponding hollowed sections provided in the upper section of the shoe to allow securement thereof. Preferably, the lateral extensions further include hooks or the like at their ends for allowing the passage of laces or straps to tighten the shoe to the lower leg and foot of the wearer.

14 Claims, 6 Drawing Sheets

SHOE FOR THE PRACTICE OF SNOWBOARDING

TECHNICAL FIELD

The invention relates to the field of sports involving gliding on snow, and more precisely to that of snowboarding. It more particularly relates to a shoe structure for the practice of snowboarding.

PRIOR ART

Shoes which allow the practice of snowboarding are made with various structures.

On the one hand, some snowboarders use boots formed principally by an upper, the lacing of which allows it to be secured to the foot and the lower leg. In general, this boot is inserted into a binding which includes straps allowing it to be secured to the snowboard. Unfortunately, when the leg flexes, the tension in the laces changes, which produces sometimes a floating sensation or sometimes a compression at the instep. Now, it is known that the circulation of blood in the foot is ensured by the artery of the foot, so that compression of the instep may lead to poor supply, which impairs the comfort and therefore the optimum practice of snowboarding.

On the other hand, there are also known shoes, used for the practice of snowboarding, which have a rigid structure which resembles that used for the practice of Alpine skiing. Unfortunately, although perfectly satisfactory as regards tightening, this type of shoe has a limited degree of comfort.

The object of the present invention is to provide a snowboarding shoe which has a flexible structure of the boot type and simultaneously ensures comfort and efficient tightening of the foot in the shoe.

BRIEF DESCRIPTION OF THE INVENTION

The invention therefore relates to a shoe for the practice of snowboarding, of the type including:

an upper enclosing the foot and the lower leg;

a sole secured to the bottom of the upper, said upper being made of a material which is more flexible than that of the sole;

means for tightening the upper onto the foot and onto the lower leg,

This shoe is one wherein the sole has lateral extensions rising over the sides of the foot, the top end of these extensions including elements intended to interact with the tightening members.

Put another way, in contrast to all existing types of snowboarding boots, the tightening of the upper onto the foot bears directly on the sole instead of on the upper. In this way, the superior rigidity of the sole permits more effective tightening.

In other words, the invention consists in tightening the upper directly on to the sole.

In practice, the extensions are integrally molded and are arranged symmetrically with respect to the vertical longitudinal plane of the shoe. In this way, tightening takes place by bringing together pairs of extensions located facing each other. In order to optimize the tightening directions, the extensions may also be arranged asymmetrically with respect to the vertical longitudinal plane of the shoe.

Moreover, in a particular embodiment, the sole includes four extensions, respectively:

the first arranged level with the toes, the second level with and just behind the metatarsophalangeal articulation, the third level with and in front of the heel/instep diagonal, the fourth level with the bottom of the tibia.

In this configuration, effective tightening is obtained with a reduced number of extensions.

Moreover, the notches corresponding to the spaces between each extension form regions for the sole to flex, and these coincide with the natural articulation axes of the foot. This device proves particularly advantageous for comfort when walking and for the sporting practice of snowboarding.

According to another feature of the invention, the upper has, in the heel/instep diagonal and on each side of the foot, an element intended to interact with the tightening members.

In this way, the tightening is ensured jointly by the extensions of the sole and by a part of the upper level with the instep. In this way, flexing of the ankle does not cause a change in tension on the instep. This hybrid tightening allows the possibility of tightening independently.

In one embodiment, the upper is made of a thermoformable plastic and has, after forming, hollowed parts intended to form housings for receiving the extensions of the sole.

Put another way, the upper is thermoformed in such a way that the sole and, in particular, its extensions, are flush-fitted under the bottom part of the upper. By virtue of this advantageous architecture, in the case of fastening by adhesive bonding, only the necessary quantity of adhesive is placed in the hollowed parts of the upper, which avoids any risk of excess adhesive protruding.

With the aim of improving the effectiveness of the tightening and of making the sole more solid, the latter includes straps joining the ends of the symmetrical extensions by passing under the foot. These straps may advantageously be embedded in the thickness of the sole.

In this way, each pair of extensions has a reinforcement arranged under the foot, between two symmetrical tightening members.

In the case of tightening by traditional lacing, the tightening means are hooks or lacing rings. In the case of tightening by loops, the tightening elements are assemblies of hooks and crossbars which are commonly used on Alpine ski boots.

Advantageously, in order to improve the user's comfort, the upper receives a removable inner shoe.

BRIEF DESCRIPTION OF THE DRAWINGS

The way in which the invention may be embodied, as well as the advantages which result therefrom, will emerge clearly from the following description of the shoe according to the invention, supported by the appended figures.

EMBODIMENT OF THE INVENTION

Figure 1:
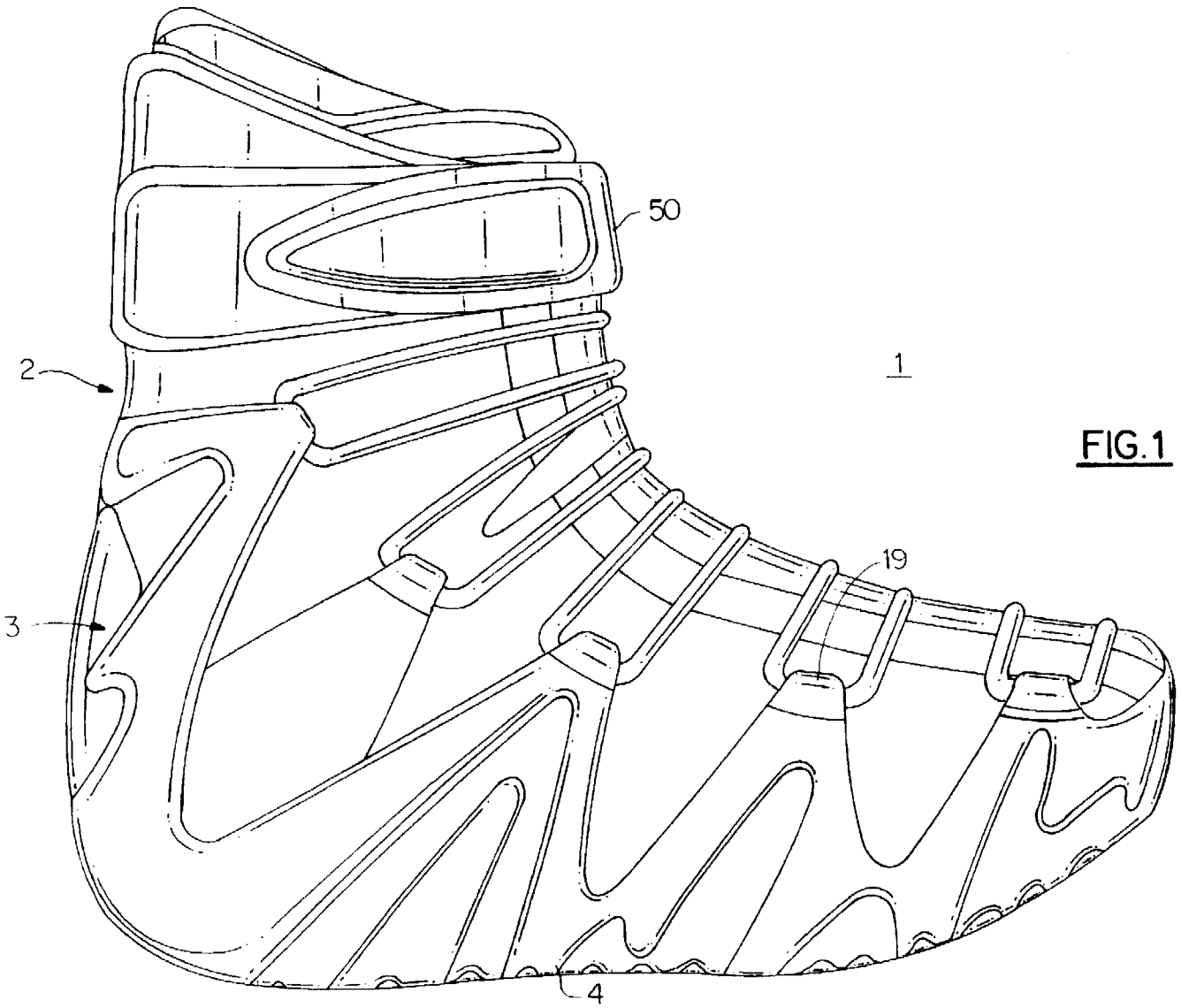
FIG. 1 is a side view of the shoe according to the invention.

As is seen in FIG. 1, the snowboarding shoe (1) according to the invention is composed of two main parts, namely the upper (2) and the sole (3).

The sole (3) has a flat top face intended to be adhesively bonded under the bottom face (5) of the upper. The bottom face (4) of the sole fulfills its traditional function as a contact surface with the ground.

Figure 5:
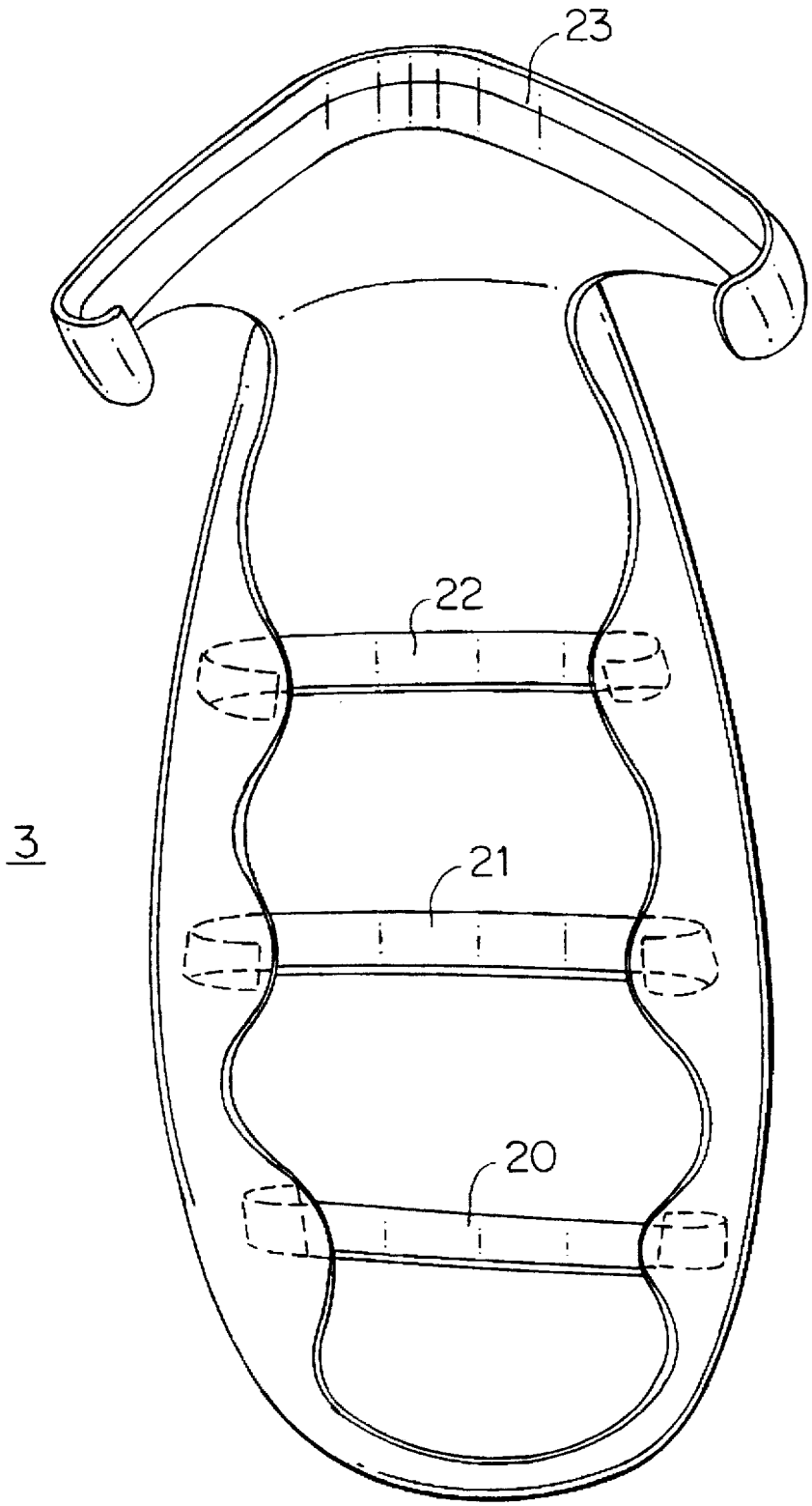
FIG. 5 is a plan view of the sole of FIG. 4.

According to the invention, the sole (3), shown independently of the upper (2) in FIG. 5, comprises a number of extensions (6–13) which rise over the side edges (14) of the upper (2).

In the nonlimiting form illustrated, there are four of these extensions (6–13), arranged along the edge of the upper. Thus, the foremost extensions (6, 7) are located substantially level with the toes, the second extensions (8, 9) are located level with and to the rear of the metatarsophalangeal articulation, the third extensions (10, 11) start substantially at the rear of the arch of the foot and are directed forward, while the last extensions (12, 13) start level with the calcaneus and are directed upward and forward above the malleoli.

The top ends of each of these extensions receive an element permitting the passage of laces (19) or the attachment of loops (18).

Figure 4:
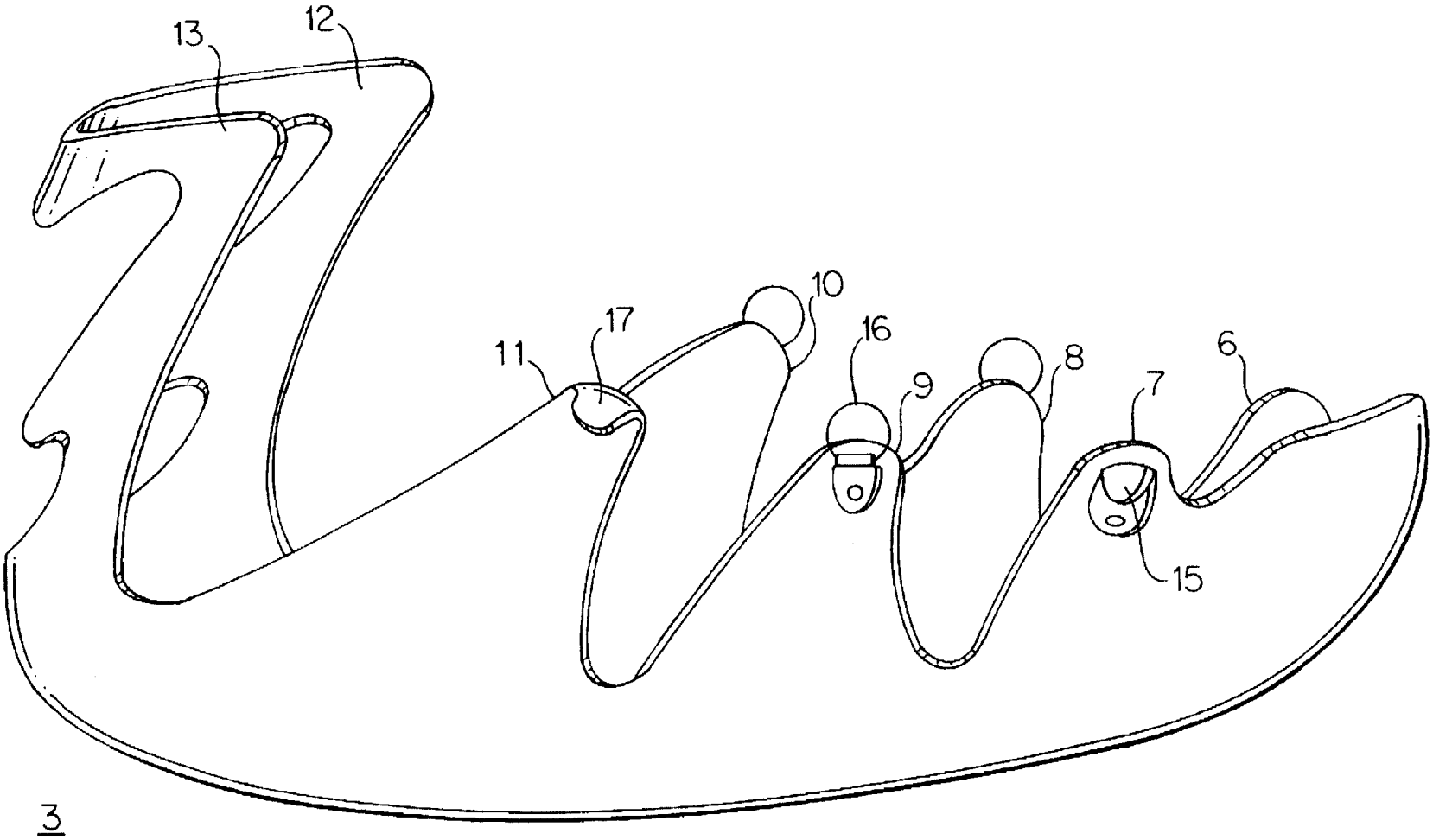
FIG. 4 is a side view of the sole.

FIG. 4 represents several types of equivalent fastening elements, namely lugs (15) or hooks commonly used in hiking boots, or rings (16) mounted on riveted bases.

According to another feature of the invention, these elements (17) may be produced directly during the molding of the sole (3), which improves the rigidity and the strength of these fastening points.

According to an advantageous arrangement the extensions (12, 13) located in the rear region of the shoe are connected together by a strap or horizontal bar. In the form illustrated in FIG. 2, these extensions (12, 13) form an integrally molded monobloc collar.

Figure 6:
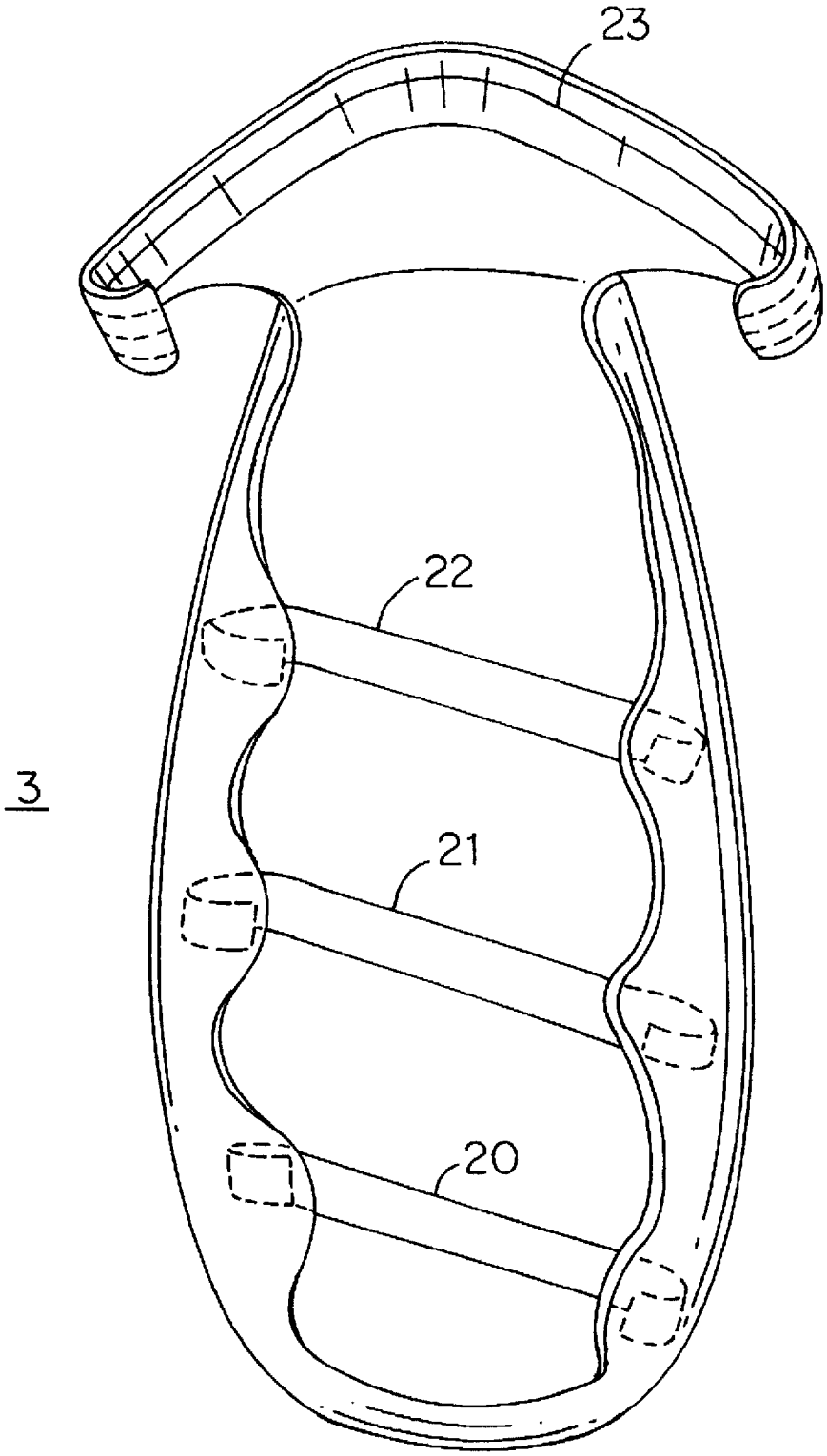
FIG. 6 is a partial side view of the shoe according to another preferred aspect of the present invention.

In order to improve the effectiveness of the lacing, the sole (3) is equipped with straps (20, 21, 22, 23) which are embedded or stitched into said sole. As is seen in FIG. 5, these straps (20, 23) join two lacing elements located on two symmetrical extensions (6–7, 8–9, 10–11, 12–13), FIG. 4, by passing over the bottom face (4) of the sole and therefore under the upper (2). It can be seen that this arrangement improves the tightening, as well as the durability of the lacing elements (15, 17) by reducing the risks of accidental tearing. These straps (20, 23) may be made either of woven textile or of rigid plastic, or else, in a more sophisticated form, by wires. FIG. 6 illustrates the lacing elements as located on similar but assymetrical extensions according to another embodiment.

The sole (3) described above is intended to be placed under the upper (2). This upper (2) has known arrangements, namely a vamp covering the front and the top of the foot, to which two lateral upright parts (26, 27), extending from the rear region of the upper, are attached. In known fashion, this upper (2) comprises a front gusset (28), level with the bottom of the tibia, which can be extended in order to allow the foot to be introduced into the upper (2). Also in known fashion, this upper receives a removable inner shoe (29) which has sufficient qualities of comfort for the user.

Figure 2:
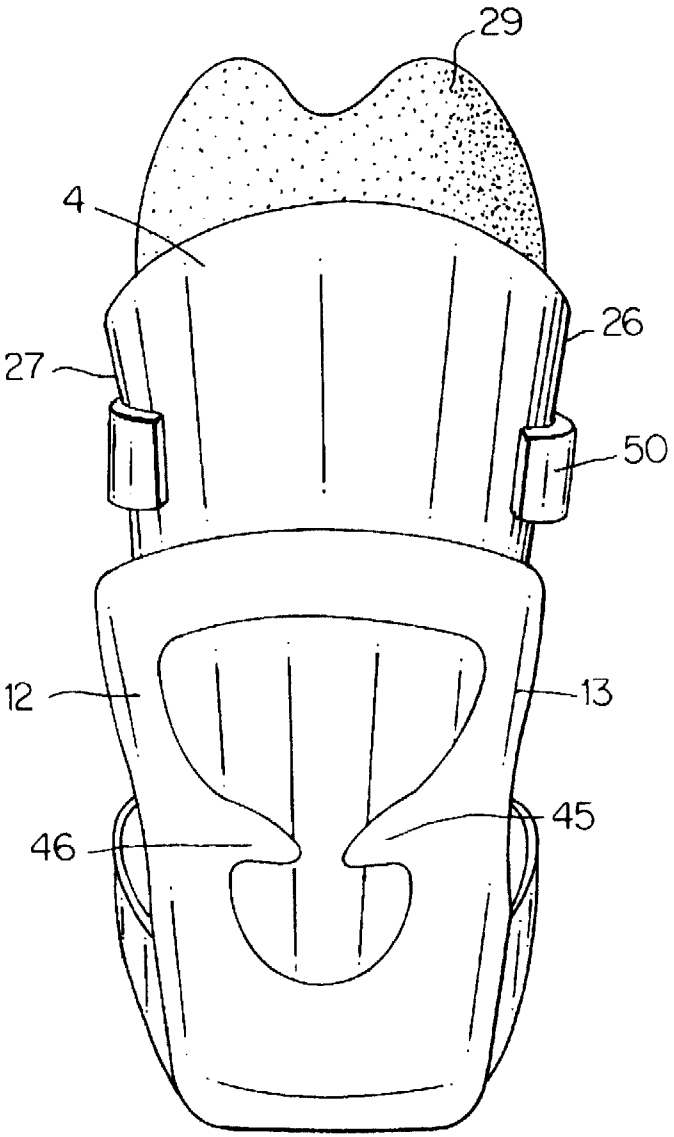
FIG. 2 is a rear view of the same shoe.
Figure 3:
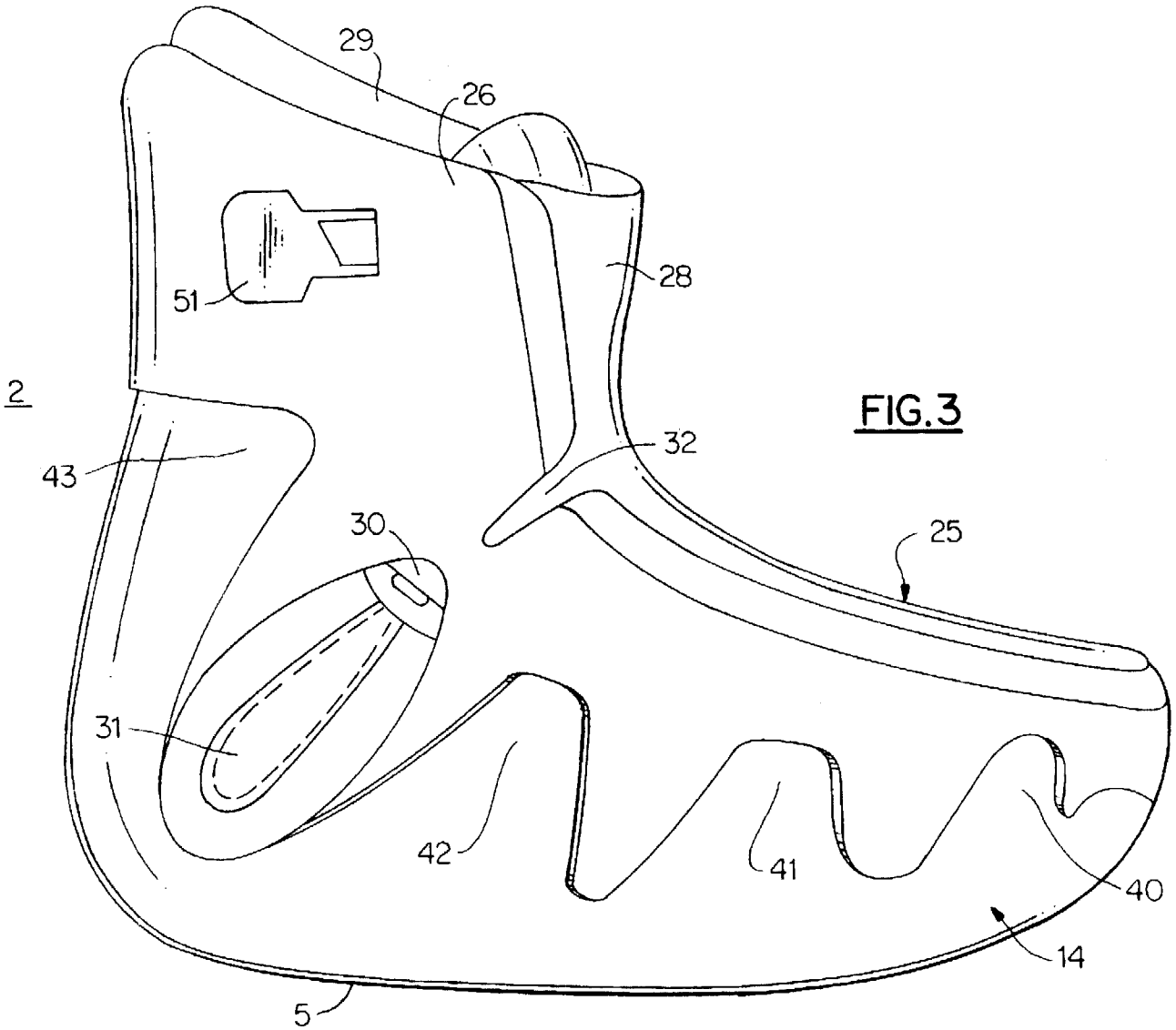
FIG. 3 is a side view of the upper, shown independently from the sole

As can be seen in FIG. 3, the upper (2) includes elements (51) allowing a strap (50), FIG. 2, to be attached level with the lower leg.

According to the invention, the upper (2) has, on each side, in the heel/instep diagonal, an element (30) intended to interact with the tightening members. This element is anchored (31) securely onto the upper (2) by stitching or riveting or any other known means. In this way, the tightening is obtained jointly by bringing the extensions (6, 13) of the sole toward each other and bringing toward each other the elements (30) anchored on the upper. This hybrid tightening permits independence and has the effect that flexing of the ankle does not cause a change in the lacing tension. In similar fashion to the straps of the sole, these two elements are joined together by a strap running around the rear of the foot, level with the bottom of the heel, again with a view to improving the tightening.

Level with the instep, the lateral upright parts (26) are separated from the vamp (25) by a notch (32) which facilitates flexing of the leg.

According to another feature of the invention, the part of the upper intended to come into contact with the sole having the particular features of the invention has hollowed parts (40, 41, 42, 43) produced by thermoforming. These hollowed parts (40, 43) are made following the contour of said sole and, in particular, of the extensions (6, 13). In this way, the sole (3) is flush-fitted inside these hollowed parts (40, 43) in order to form a compact assembly with the upper. This arrangement makes it possible, during adhesive bonding, to spread the adhesive only in the hollowed parts, with the effect that undesired protrusions of excess adhesive are avoided during positioning. With a view to improving the flush-fitting of the sole on to the upper, provision may also be made for providing relief parts inside the hollowed parts (40–43), these relief parts corresponding to complementary recesses formed for this purpose on the sole.

The geometries of the rear part of the sole and, in particular, of the tongues (45, 46) are directed from the malleoli toward the Achilles tendon, which allows the sole to form a brace which is advantageous in terms of holding and in terms of rigidity of the shoe. The geometry of this rear region can thus be altered at will in order to obtain the desired rigidity.

The snowboarding shoe according to the invention has the advantage that it produces tightening of the upper onto the foot and then directly onto the sole, which makes it possible to obtain much more effective tightening than is the case with all existing shoe types.

I claim:

1. A shoe for use in snowboarding comprising:

an upper section having a bottom and opposed sides that enclose a wearer's foot and lower leg, said upper section being formed of a thermoformed plastic; and a sole that is secured to the bottom of said upper section, said sole being formed of a material that is less flexible than the thermoformed material of the upper section, wherein said sole further includes a plurality of pairs of lateral extensions rising upwardly along the opposed sides of the upper section, and said upper section includes a plurality of hollowed sections, each hollowed section being sized for engaging a corresponding lateral extension of said sole to allow flush fitting therebetween.

2. The shoe of claim 1, wherein each of lateral extensions includes a top end having a connecting element, said shoe further includes means engageable with each connecting element for tightening said upper section with the upper leg and foot of a wearer.

3. A shoe as recited in claim 2, wherein said upper section further includes an element on either side thereof adjacent the heel/instep diagonal of a wearer for connecting the upper section to the tightening means.

4. A shoe as recited in claim 2, wherein said tightening means are from the group consisting of laces and hooks.

5. The shoe of claim 1, wherein said lateral extensions are integrally molded with the sole.

6. The shoe of claim 1, wherein each of the pairs of lateral extensions are arranged symmetrically with a vertical longitudinal plane of said shoe.

7. The shoe of claim 1, wherein each of the pairs of lateral extensions are arranged asymmetrically with a vertical longitudinal plane of said shoe.

8. A shoe as recited in claim 1, wherein said sole has four pairs of extensions including:

a first pair that are level with a wearer's toes, a second pair level with a wearer's metatarsophalangeal articulation, a third pair level with and in front of a wearer's heel/instep diagonal, and a fourth pair that is level with the bottom of a wearer's tibia.

9. A shoe as recited in claim 1, wherein said sole further includes a plurality of reinforcing straps disposed between each of said pairs of lateral extensions for passing under the foot of a wearer and for joining said extensions.

10. A shoe as recited in claim 9, wherein said straps are at least partially embedded in said sole.

11. A shoe as recited in claim 9, wherein said straps are stitched into said sole.

12. A shoe as recited in claim 1, including a removable inner boot fitted within said upper section.

13. A shoe as recited in claim 1, wherein said upper section includes a pair of lateral upright parts extending from a vamp covering the top and front of the foot, wherein said lateral upright parts and said vamp are separated by a notch to allow flexing of the leg by a wearer.

14. A shoe as recited in claim 13, wherein said notch is arranged approximately level with the instep of a wearer.

* * * * *